United States Patent [19]

Eberhardt et al.

[11] 4,448,256

[45] May 15, 1984

[54] FOAM LIQUID PROPORTIONER

[75] Inventors: H. Alfred Eberhardt, Paoli; Kenneth F. Hoffman, Collegeville; Raymond R. Petersen, Meadowbrook, all of Pa.

[73] Assignee: Hale Fire Pump Company, Conshohocken, Pa.

[21] Appl. No.: 392,710

[22] Filed: Jan. 28, 1982

[51] Int. Cl.[3] ..... A62C 35/00

[52] U.S. Cl. ..... 169/15; 417/405

[58] Field of Search ..... 169/13-15; 417/405; 137/98, 97

[56] References Cited

U.S. PATENT DOCUMENTS 1,137,927 5/1915 Thomas ..... 169/15

2,543,941 3/1951 Sargent ..... 169/15

*Primary Examiner*—Joseph J. Rolla

*Assistant Examiner*—Kenneth Noland

*Attorney, Agent, or Firm*—Harding, Earley, Follmer & Frailey

[57] ABSTRACT

A foam liquid proportioner including a positive displacement water motor coupled to a positive displacement foam liquid pump is provided with a gear drive mechanism which steps up the RPM of the foam liquid pump to be much higher than the RPM of the water motor to a speed so as to reduce the ratio of the slippage of foam liquid to the total flow of the foam liquid through the foam liquid pump.

5 Claims, 4 Drawing Figures

10
12
20
21
22
23
24
26
28
30
32
33
35
42
43
44
45
60
62
2
3
4

FIG. 2
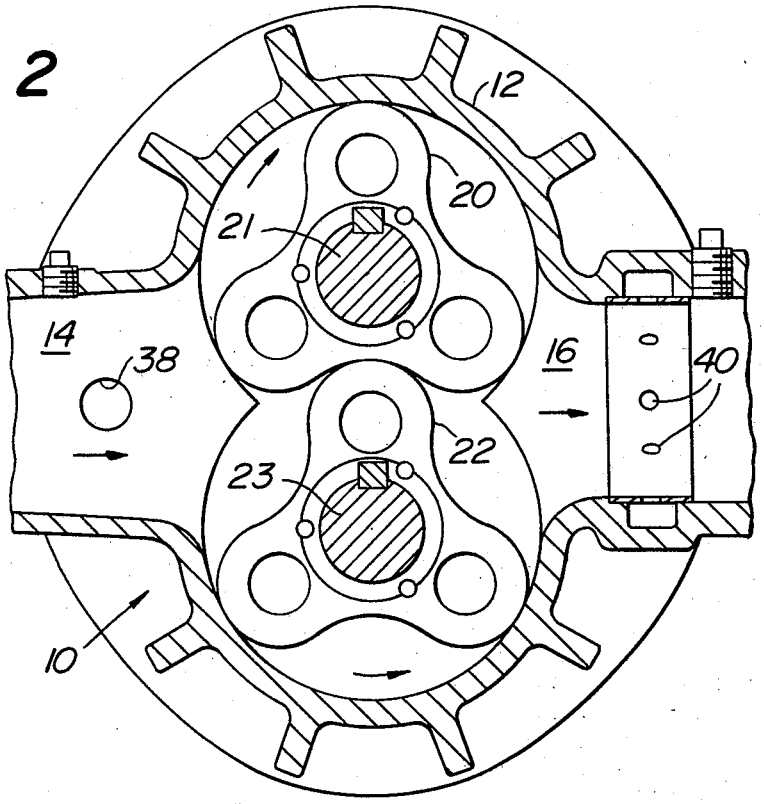
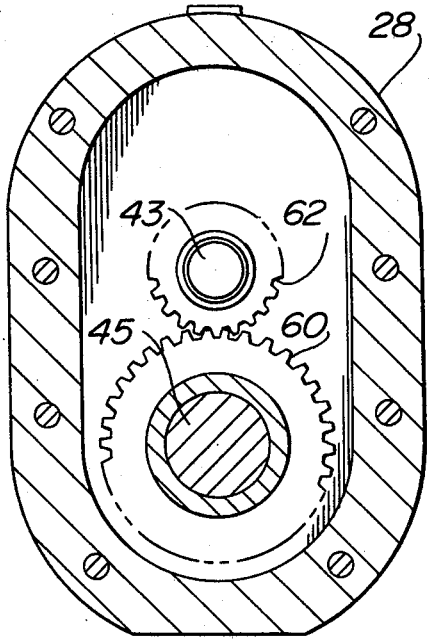
FIG. 3

FOAM LIQUID PROPORTIONER

BACKGROUND AND SUMMARY OF THE INVENTION

This invention relates to proportioning devices of the type used in fire-fighting apparatus for introducing foam producing liquid into the stream of water being pumped to the fire fighting location. Devices of this type are well known and are disclosed in U.S. Pat. No. 2,543,941.

The prior art devices comprise a positive displacement water motor coupled to a positive displacement foam liquid pump. The water motor is placed in a conduit through which water is discharged from a pressurized source and may consist of a rotary pump wherein intermeshing rotors are synchronized. The foam pump is placed in a conduit which bypasses the water motor and may consist of a gear type pump including two toothed rotors driven directly off of the water motor at the same RPM. In operation, flow through the fire line, which includes the conduit containing the water motor, drives the water motor causing the direct-connected foam liquid pump to inject a metered amount of foam liquid into the stream being fed to the fire-fighting location.

Typically, the foam pump and water motor are sized so that their combined discharge consists of 6% foam liquid and 94% water, with the percentage of foam liquid varying somewhat for different flow and inlet pressure conditions. The foam pump is a much smaller displacement device than the water motor to accommodate these conditions.

A problem with the prior art devices is that the slippage in the foam pump (ie., the leakage of liquid from the discharge of the foam pump back to its suction side) is a considerable amount. Moreover, the proportion of this leakage to the total flow is substantial.

It is the general object of this invention to improve foam liquid proportioners of the indicated type by reducing the proportion of the slippage to the total foam flow in the foam pump. To this end, the foam liquid proportioner of the invention is provided with a simple, self contained, gear step-up means for substantially increasing the RPM of the foam pump relative to the RPM of the water motor. By operating the foam pump at a high RPM, the total flow rate is increased and the slippage, which is a relatively fixed amount, is a smaller proportion of the total flow. In other words, the ratio of slippage to the total flow is reduced.

Since the foam liquid pump is substantially smaller in size than the water motor, it can be operated at much higher speeds than the water motor without any mechanical problems. Accordingly, the foam pump RPM can be increased to a ratio of 2 to 1 or 3 to 1 relative to the water motor without incurring any mechanical problems.

BRIEF DESCRIPTION OF THE DRAWINGS

FIG. 2 is a sectional view taken generally on line 2—2 of FIG. 1.

FIG. 3 is a sectional view taken generally on line 3—3 of FIG. 1.

DETAILED DESCRIPTION OF THE PREFERRED EMBODIMENT

Figure 1:
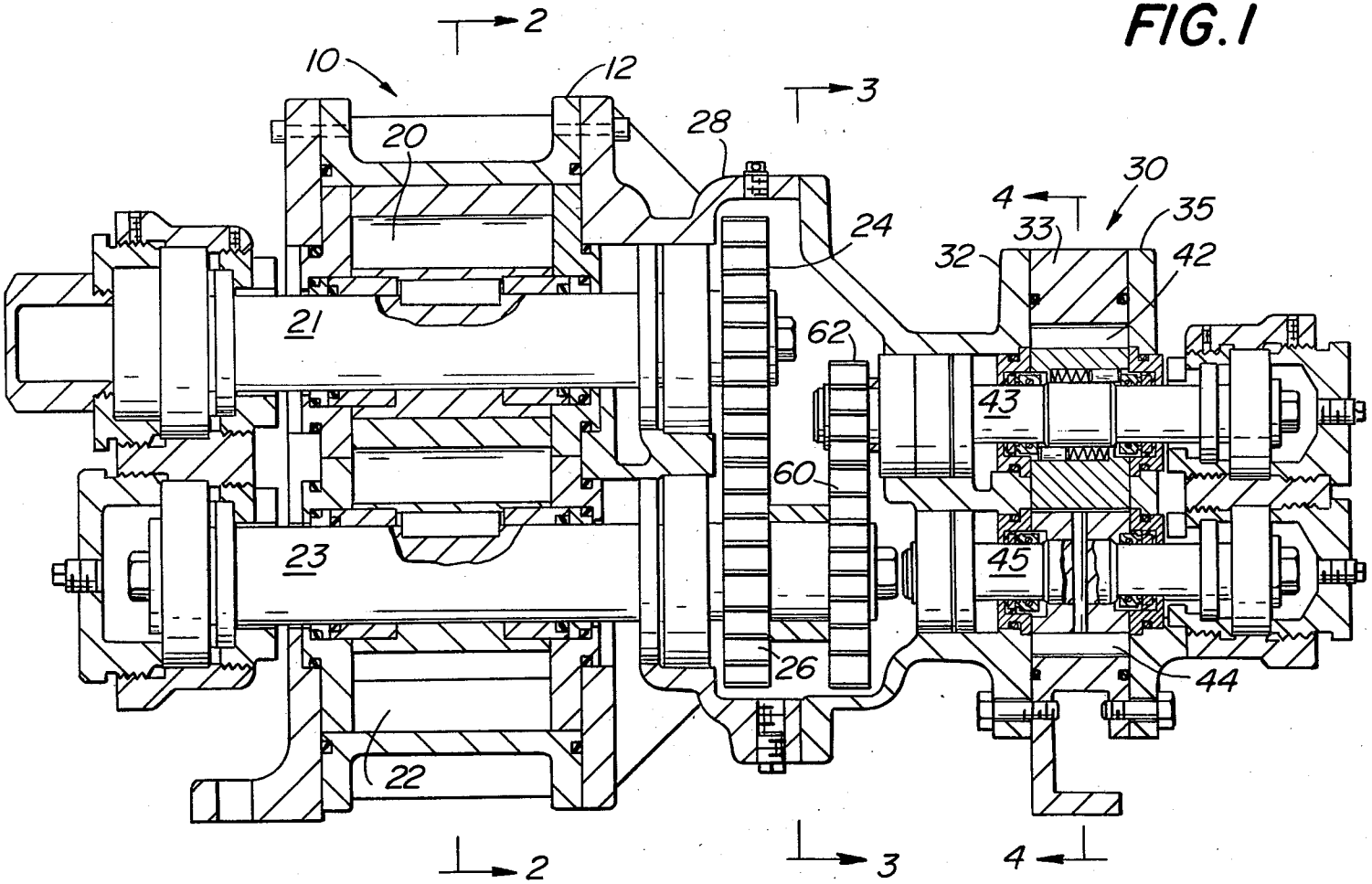
FIG. 1 is an elevational view of cross-section of a foam liquid proportioner in accordance with the invention.

The foam liquid proportioner of the invention comprises a positive displacement water motor indicated generally at 10 and contained within a body 12 which defines an inlet passage 14 and a discharge passage 16. In use, fire hoses are connected to body 12 adjacent inlet passage 14 and discharge passage 16 and a pressurized source of water is applied to the inlet passage 14 so that a stream of water is caused to flow from inlet passage 14 through the water motor 10 to discharge passage 16 as shown by the arrows in FIG. 2. Water motor 10 is in the form of a conventional design including a pair of positive displacement 3-lobed rotary intermeshing hydraulic motor rotors 20 and 22 synchronized by timing gears 24 and 26 mounted on shafts 21 and 23, respectively, thereof. Timing gears 24 and 26 are contained within a motor mounting head 28 as shown in FIG. 1.

Figure 4:
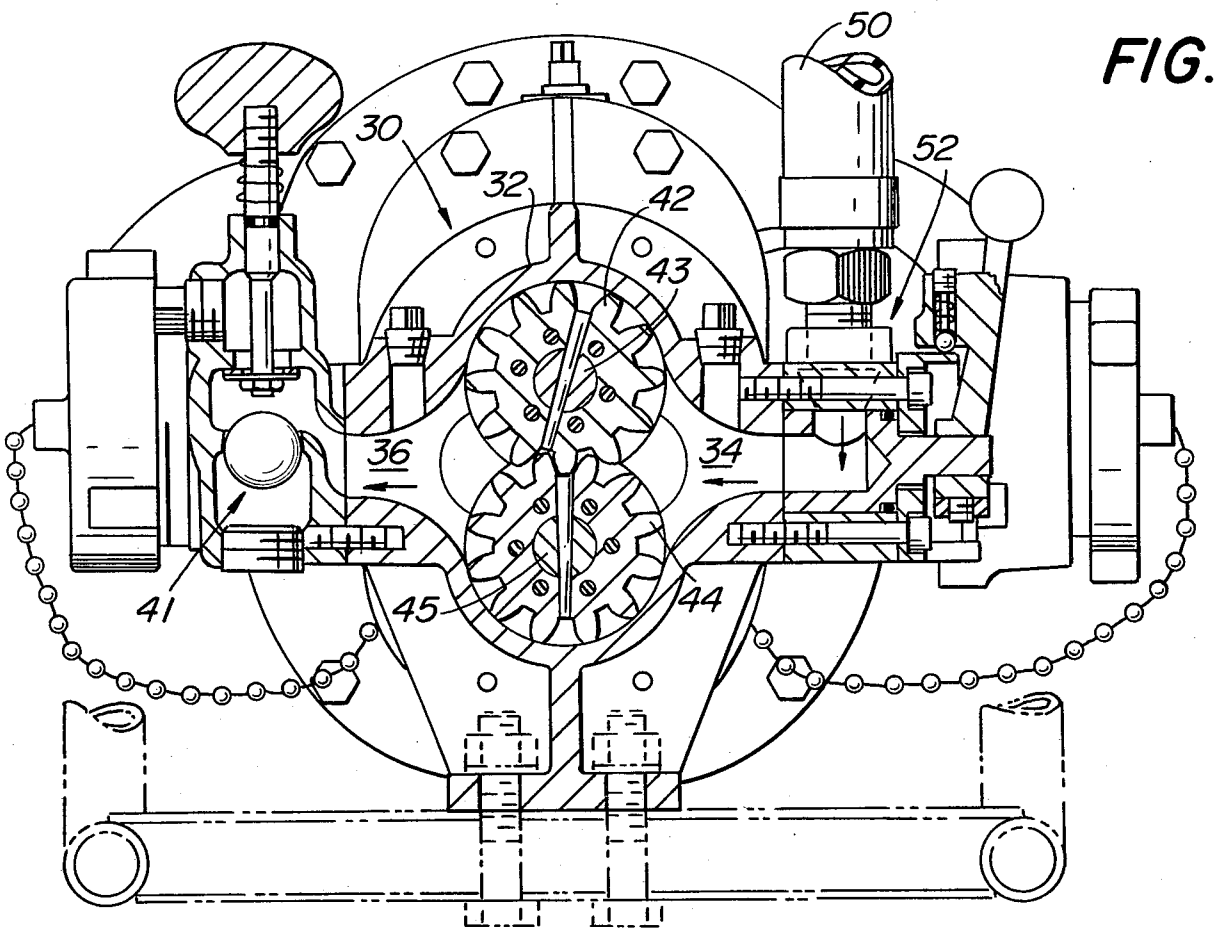
FIG. 4 is a sectional view taken generally on line 4—4 of FIG. 1.

A foam liquid pump 30 is mounted in a flow path which bypasses water motor 10 and comprises a pump mounting head 32 which defines one side of the foam pump, a pump body 33 which includes a pump inlet passage 34 and a pump discharge passage 36 as shown in FIG. 4, and a pump head 35 which defines the other side of the foam pump. Pump inlet passage 34 is connected to the inlet side of water motor 10 and pump discharge passage 36 is connected to the discharge side of water motor 10 by suitable flow tubes (not shown), the exit port from the inlet side of water motor 10 being indicated at 38 and the inlet ports to the water motor outlet from the discharge side of foam pump discharge passage 36 being indicated at 40 (FIG. 2). As is conventional, a ball check valve 41 is located in the flow path between the discharge 36 of foam pump 30 and the discharge passage 16 of water motor 10.

Foam pump 30 is a positive displacement pump of a conventional gear type consisting of a pair of rotors 42 and 44 comprising shafts 43 and 45, respectively, and contained within body 33 and between mounting head 32 and pump head 35. Shaft 43 of rotor 42 is driven from water motor 10 by means of a drive connection to be described more fully hereafter and, as is conventional, the rotor 42 drives intermeshing rotor 44 to cause the pumping of the foam liquid in the direction of the arrows shown in FIG. 4.

Foam liquid is introduced into inlet passage 34 from a suitable source (not shown) by way of a foam pickup tube 50, the connection between the tube 50 and inlet passage 34 being controlled by a manual control valve 52, as is conventional.

Means are provided for driving water motor rotors 20, 22 and foam pump rotors 42, 44 in a synchronized relation so that an exact amount of foam liquid will be delivered to the discharge ports 40 and so that this amount will be accurately proportioned to the quantity of water flowing through water motor 10. To this end, there is provided a step-up gear arrangement for causing the foam pump 30 to have a much greater RPM than the water motor 10. Such means comprises a large gear 60 mounted on the end of the shaft 23 of rotor 22 outside of timing gear 26, as is shown in FIG. 1, and a small gear 62 which is mounted on the end of the shaft 43 of rotor 42 of the foam pump 30. As is shown in FIG. 1, small gear 62 meshes with large gear 60 so as to be driven thereby at a much higher RPM than the shaft 23 of rotor 22. By this arrangement shaft 43 will be driven at a much higher RPM than shaft 23 whereby rotors 42 and 44 of foam pump 30 are caused to rotate at a higher RPM than rotors 20 and 22 of water motor 10. By reason of the higher RPM of the foam pump 30, the slippage, (which is an approximately fixed amount) of the foam liquid will be, in proportion, relatively small as compared with the total volume of foam liquid flow through the foam pump 30. Accordingly, the volumetric efficiency of the foam liquid pump will be higher using the step-up gear drive of the invention than is possible with a conventional direct drive arrangement; and, an improved device is provided.

What is claimed is:

1. In a foam liquid proportioner for introducing foam producing liquid into a stream of water including a water motor driven by the flow of water discharged from a pressurized source and flowing through a flow path containing the water motor, and a foam liquid pump in a flow path which bypasses the water motor and arranged to inject a metered amount of foam liquid into said stream of water, said water motor having a rotor means including a rotating shaft driven by the water flowing through the water motor, said foam liquid pump having rotor means including a rotating shaft, the improvement comprising step-up gear means in a drive connection between said water motor rotor means and said foam liquid pump rotor means for causing said foam liquid pump rotor means to rotate at a speed which is much faster than speed of rotation of said water motor rotor means to reduce the ratio of the liquid slippage flow to the total flow of said foam liquid pump, said step-up gear means including a large gear mounted on said rotating shaft of said water motor and a small gear mounted on said rotating shaft of said foam liquid pump in engagement with said large gear which said small gear is to be driven thereby at a stepped-up RPM, and a mounting head means for mounting said foam liquid pump adjacent to said water motor with the longitudinal axis of said rotating shaft of said water motor being parallel to and spaced apart from the longitudinal axis of said rotating shaft of said foam liquid pump, said mounting head means defining a gear chamber between said water motor and said foam liquid pump, said rotating shaft of said water motor having an extended portion extending into said gear chamber and having said large gear mounted thereon, said rotating shaft of said foam liquid pump having an extended portion extending into said gear chamber and having said small gear mounted thereon for direct engagement with said large gear.

2. A foam liquid pump according to claim 1 wherein said water motor comprises a pair of positive displacement 3-lobed rotary hydraulic motor rotors.

3. A foam liquid proportioner according to claim 2 wherein said foam liquid pump is a positive displacement gear pump including a pair of meshing rotors.

4. A foam liquid proportioner according to claim 1 wherein said foam liquid pump is a positive displacement gear pump including a pair of rotors.

5. A foam liquid proportioner according to claim 1 including a timing gear for said water motor mounted on said extended portion of said rotating shaft thereof inwardly of said large gear mounted thereon.

* * * * *